US006750773B2

(12) United States Patent
Higgins

(10) Patent No.: US 6,750,773 B2
(45) Date of Patent: Jun. 15, 2004

(54) LIQUID FLOW METER

(75) Inventor: Michael Higgins, La Habra Heights, CA (US)

(73) Assignee: Falcon Waterfree Technologies, Los Angeles, CA (US)

( * ) Notice: Subject to any disclaimer, the term of this patent is extended or adjusted under 35 U.S.C. 154(b) by 54 days.

(21) Appl. No.: 10/143,103

(22) Filed: May 7, 2002

(65) Prior Publication Data

US 2002/0163432 A1 Nov. 7, 2002

Related U.S. Application Data

(60) Provisional application No. 60/289,159, filed on May 7, 2001, and provisional application No. 60/311,472, filed on Aug. 10, 2001.

(51) Int. Cl.[7] ..... G08B 21/00

(52) U.S. Cl. ..... 340/604; 200/61.04

(58) Field of Search ..... 340/604; 200/61.04, 200/61.05, 61.07, 182, 184, DIG. 41

(56) References Cited

U.S. PATENT DOCUMENTS 4,773,863 A * 9/1988 Douglas, III ..... 434/247
4,800,370 A * 1/1989 Vetecnik ..... 340/573.5
5,036,859 A * 8/1991 Brown ..... 600/547
5,043,704 A * 8/1991 Blakeney ..... 340/573.5
5,327,473 A * 7/1994 Weigert ..... 377/21
5,560,051 A * 10/1996 Butts ..... 4/479
6,425,411 B1 * 7/2002 Gorges ..... 137/247.39

* cited by examiner

*Primary Examiner*—John Tweel
(74) *Attorney, Agent, or Firm*—Lewis B. Sternfels

(57) ABSTRACT

A liquid flow meter (50), including a microcontroller (60) and associated algorithm, monitors urine flow through a cartridge trap (20). Measuring the duration of such flow and the number of times the urinal is used will determine, in accordance with preset criteria, when servicing or replacement is needed, and alerts a service person to that effect by a warning light (68) or other signal. Because urine has a high mineral content, it is electrically conductive, effective to complete circuits between closely spaced metal contacts (62*a*–62*c*, 64*a*–64*c*) coupled to the PROM, which allows the manner and existence of the urine to be detected. The liquid flow meter is installed in the cartridge trap by utilizing and placing a split ball stem (52) located at the base of the meter into a mounting hole (42) located in the center of the drain holes (36) on the cartridge cover (26).

11 Claims, 8 Drawing Sheets

FIG. 17

| VARIABLE | INITIATION OF EVENT | ACTION | X=DURATION OR UNITS | |
|---|---|---|---|---|
| X1 | LIQUID CONTACTS SENSOR FOR NORMAL USE | COUNTER #1 RECORDS 1 USE, COUNTER #1 WILL NOT ACTIVATE AGAIN UNTIL TIMER #1 REACHES "X" SECONDS AND SENSOR IS OPEN | 50 | SECONDS |
| X2 | LIQUID CONTACTS SENSOR FOR NORMAL USE | LED IS ACTIVATED FOR "X" SECONDS, EACH USE (NOTE* THIS FEATURE WILL NOT BE ACTIVE ON PRODUCTION MODELS) | 0.1 | SECONDS |
| X3 | BLOCKAGE OCCURS FOR EXTENDED PERIOD OF TIME | TIMER #2 REACHES "X" NUMBER OF SECONDS, COUNTER #2 RECORDS "1" BLOCKAGE. | 75 | SECONDS |
| X4 | BLOCKAGE OCCURS FOR EXTENDED PERIOD OF TIME | COUNTER #2 RECORDS "X" BLOCKAGES CONSECUTIVELY, WARNING LED IS ACTIVATED. IF BLOCKAGE OCCURS LESS THAN "X" TIMES CONSECUTIVELY, COUNTER #2 IS RESET TO "0" (NOTE IF THE SENSOR IS CLOSED COUNTER #2 CANNOT RECORD ANOTHER EVENT UNTIL SENSOR IS OPEN.) | 3 | TIMES |
| X5 | LIQUID CONTACTS SENSOR FOR NORMAL USE | COUNTER #1 REACHES "X" NUMBER OF USES, THE WARNING LED IS ACTIVATED | 7000 | TIMES |
| X6 | WARNING LED IS ACTIVATED | LED ACTIVATES FOR "X" SECONDS | 0.1 | SECONDS |
| X7 | WARNING LED IS ACTIVATED | LED ACTIVATES "X" NUMBER OF TIMES PER MINUTE | 20 | TIMES |
| X8 | RESET/WARNING STATE | IF SENSOR CONTACTS ARE CLOSED "X" NUMBER OF TIMES WITHIN 4 SECONDS, GO INTO WARNING STATE. IF SENSOR CONTACTS ARE CLOSED "X" NUMBER OF TIMES WITHIN 4 SECONDS AGAIN RESET ALL COUNTERS AND TIMERS TO ZERO | 5 | TIMES |
| | | | | |
| | NOTE | AFTER ANY PIN CHANGE OCCURS, CHIP SHOULD BE PUT INTO SLEEP MODE UNTIL NEW PIN CHANGE, TO CONSERVE BATTERY DRAIN | | |

LIQUID FLOW METER

CROSS-REFERENCE TO RELATED APPLICATION

This application claims the benefit of U.S. Provisional Applications No. 60/289,159 filed May 7, 2001 and No. 60/311,472 filed Aug. 10, 2001.

REFERENCE REGARDING FEDERAL SPONSORSHIP

Not Applicable

REFERENCE TO MICROFICHE APPENDIX

Not Applicable

1. Field of the Invention

The present invention relates to a device and method for monitoring the flow of liquids and, more particularly, for monitoring the flow of urine in a urinal, such as a waterless urinal, to determine when a trap cartridge needs to be changed or serviced.

2. Description of Related Art and Other Considerations

Waterless urinals, such as are disclosed in U.S. Pat. No. 6,053,197 and U.S. Pat. No. 6,425,411 typically use a water trap in which a low density sealant layer covers a small amount of wastewater remaining in the urinal trap. Such urinals conventionally do not have a flush mechanism; therefore, some amount of wastewater will remain in the trap at all times. The sealant layer prevents odors from escaping from and through the wastewater. Any slow draining of wastewater from the trap or blocking within the trap or sufficient use of the urinal to cause the supply of sealant to be significantly diminished, will result in unpleasant odors. Therefore, it is important for such urinals to be cleaned and serviced regularly, and especially when draining slowly, and a need exists for determining when the conditions for cleaning and servicing pertain.

SUMMARY OF THE INVENTION

These and other problems are successfully addressed and overcome by the present invention, along with attendant advantages. The present invention employs an electric device, including a PROM and associated algorithm, to monitor urine flow through the cartridge trap. Measuring the duration of such flow and the number of times the urinal is used will determine, in accordance with preset criteria, when servicing or replacement is needed, and alerts a janitor or repairman or other service person by a warning light or other signal. Because urine has a high mineral content, it is electrically conductive, effective to complete circuits between closely spaced metal contacts coupled to the PROM, which allows the manner and existence of the urine to be detected.

Other aims and advantages, as well as a more complete understanding of the present invention, will appear from the following explanation of an exemplary embodiment and the accompanying drawings thereof.

BRIEF DESCRIPTION OF THE DRAWINGS

FIG. 17 is a chart setting forth the variables for programming the computer chip used in the liquid flow meter.

DETAILED DESCRIPTION

Figure 1:
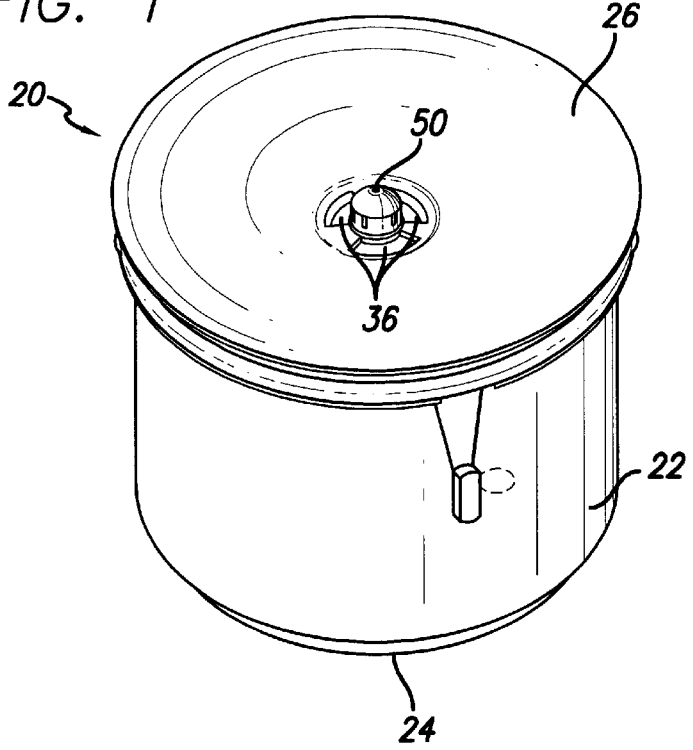
FIG. 1 is a perspective view of the present invention depicting a removable trap utilized in a urinal with a liquid flow meter installed therein.
Figure 2:
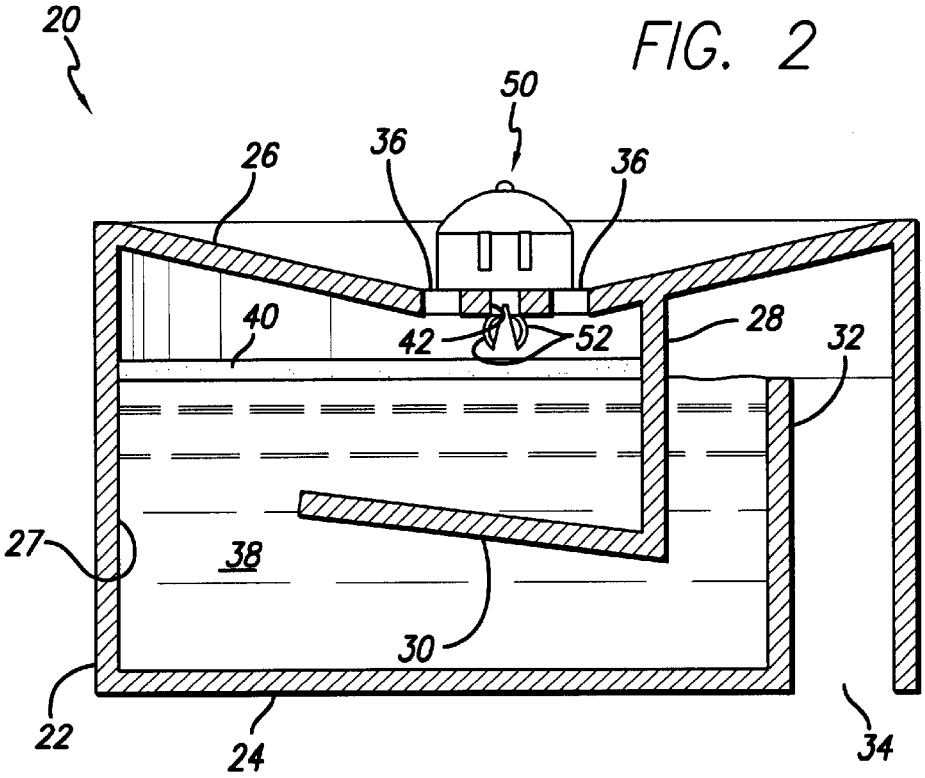
FIG. 2 is a cross-sectional view of the present invention illustrated in FIG. 1.

Accordingly, as depicted in FIGS. 1 and 2, an odor trap 20, such as disclosed in above-mentioned U.S. Pat. No. 6,053,197 and U.S. patent application, Ser. No. 09/855,735, comprises a cylindrical housing 22, a bottom portion 24 and a cover or top portion 26, which define an interior 27. Internally, odor trap 20 includes a vertical baffle 28 secured to and extending downwardly from cover 26, a sloped, generally horizontal baffle 30 secured to vertical baffle 28 and an overflow riser 32 extending upwardly from bottom portion 24. Overflow riser 32 comprises a walled section to form a discharge path from interior 27 of trap 20 through an exit 34 which is coupled to an external drain system. An entry 36 forms an opening into interior 27.

The interior is adapted to retain a conductive liquid 38, e.g., wastewater such as a mixture of water and urine, on which a sealant layer 40 of oily substance floats. Accordingly, the wastewater enters odor trap 20 through one or more openings 36, flows into and passes through sealant layer 40, and flows atop and beneath baffle 30 on its journey over overflow riser 32 and out of the odor trap through exit 34.

Cover 26 is further provided with a centrally positioned opening 42, surrounded by entry 36.

Figure 5:
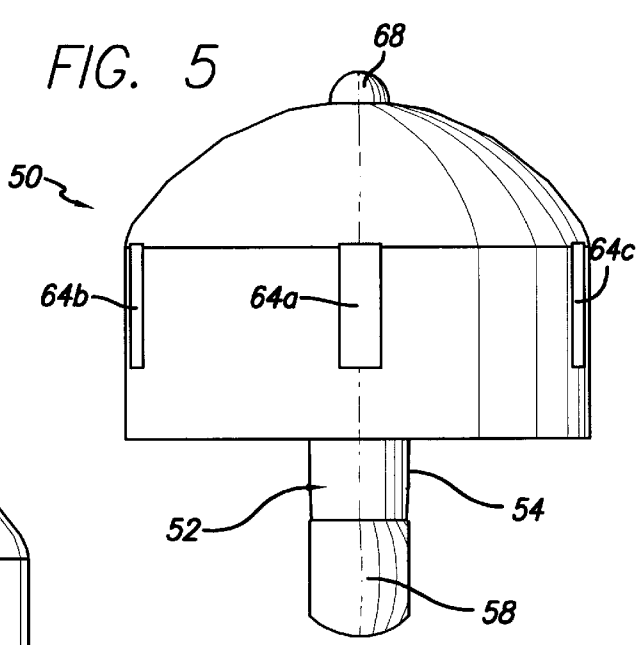
FIGS. 4 and 5 are side views of the exterior or cover of the liquid flow meter, with one taken 90° from the other.
Figure 4:
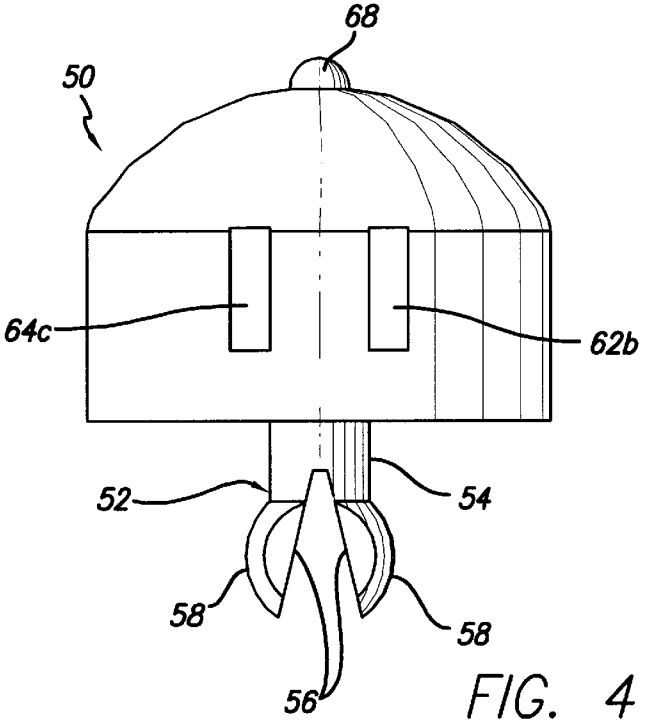
Figure 3:
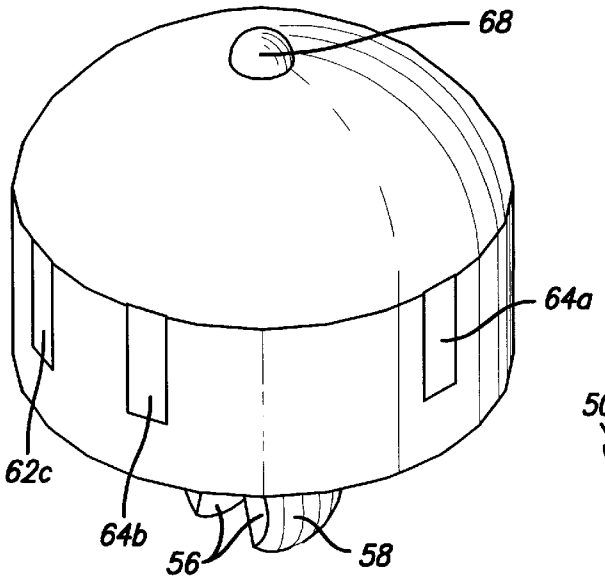
FIG. 3 is a perspective view of the liquid flow meter taken from its exterior or cover.

As illustrated generally in FIGS. 3–5 and in greater detail in FIGS. 7–15, a liquid flow meter 50 is adapted to be secured to odor trap 20 at cover opening 42. Specifically, meter 50 is provided with connector 52 comprising a post 54 terminating in a pair of tangs 56 with bulbous bosses 58. Cover opening 42 and post 54 have approximately equal diameters to permit bosses 58 to pressed tangs 56 together as they pass through the cover opening and thence to snap outwardly to latch the liquid flow meter to odor trap 20.

Figure 6:
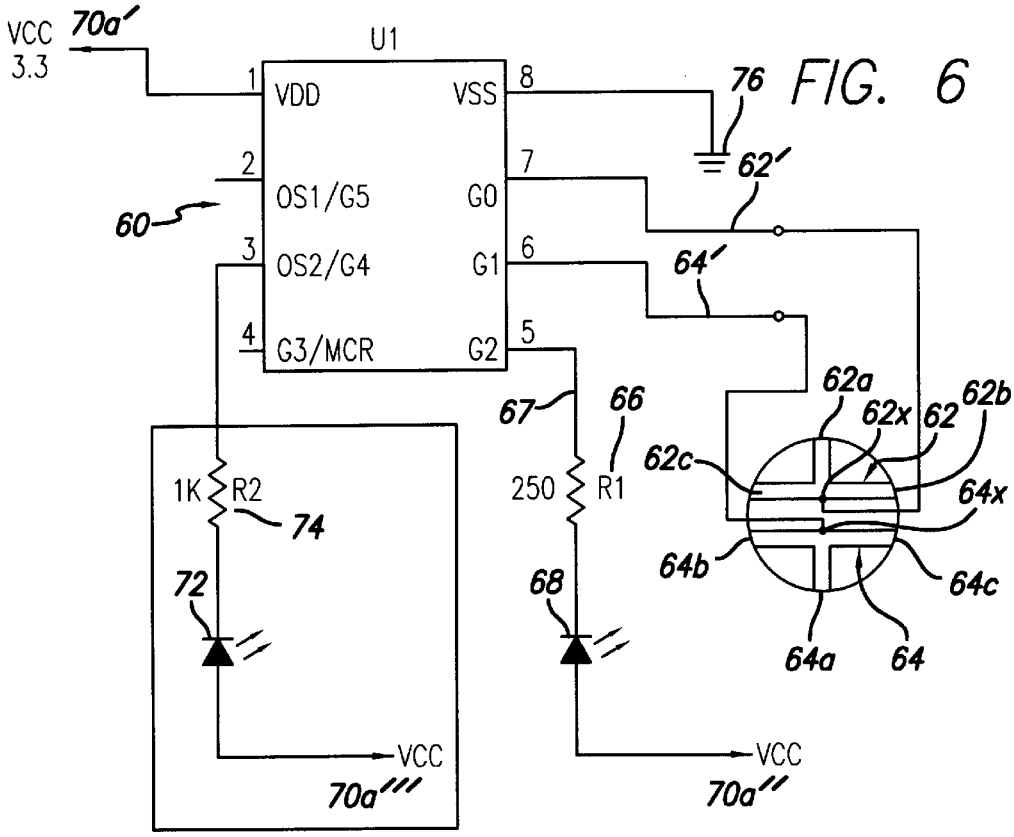
FIG. 6 is an electric schematic diagram of the of the liquid flow meter.
Figure 8:
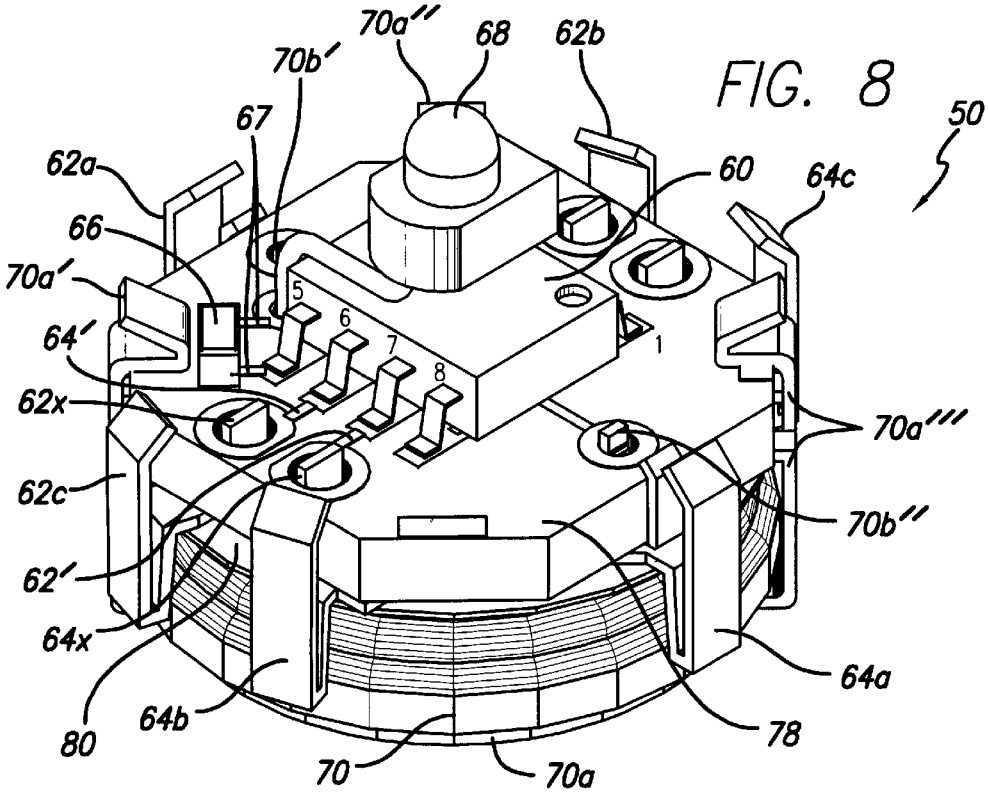
FIG. 8 is a perspective view of the liquid flow meter depicted in FIG. 3 with its outer cover removed to disclose the interior components thereof.
Figure 7:
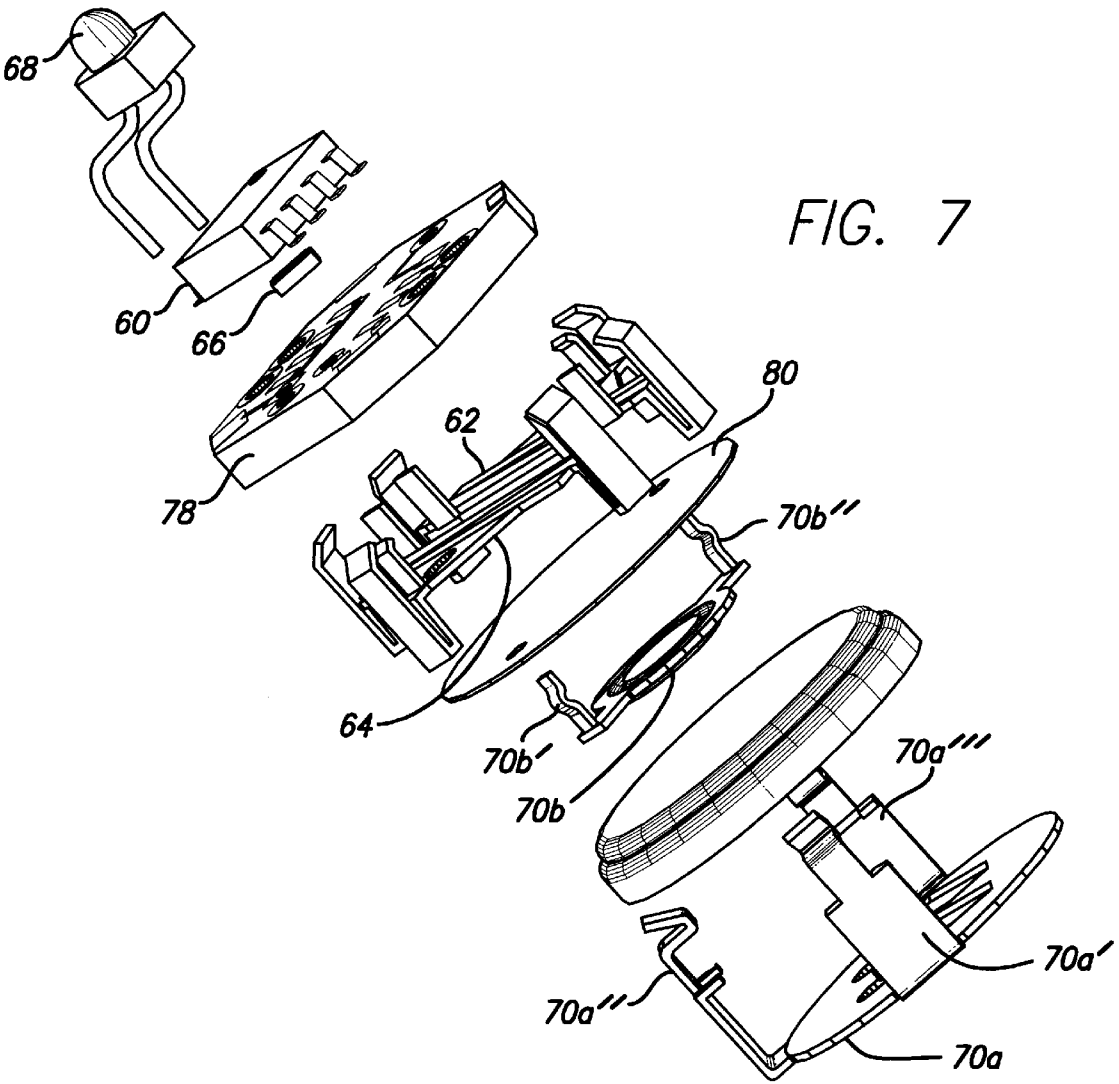
FIG. 7 is an exploded perspective view of the present invention.
Figure 10:
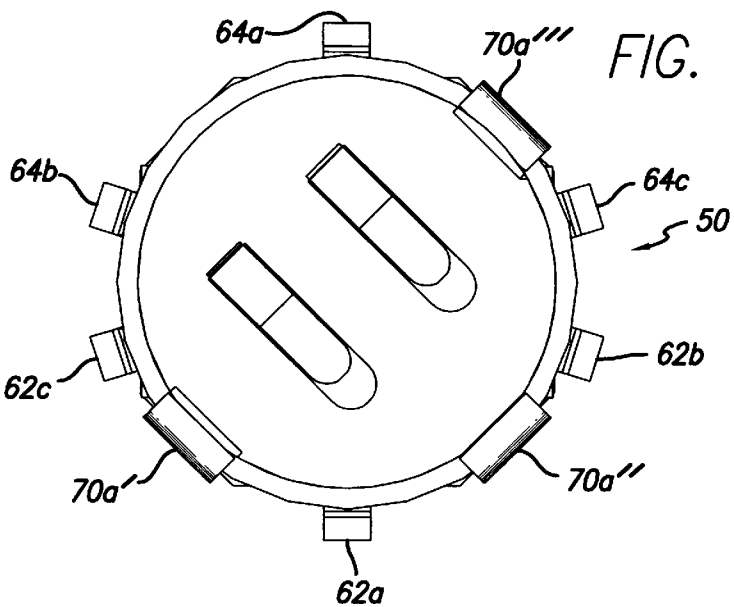
FIG. 10 is a bottom, upwardly looking view of the liquid flow meter, taken 90° from that depicted in FIG. 9.
Figure 9:
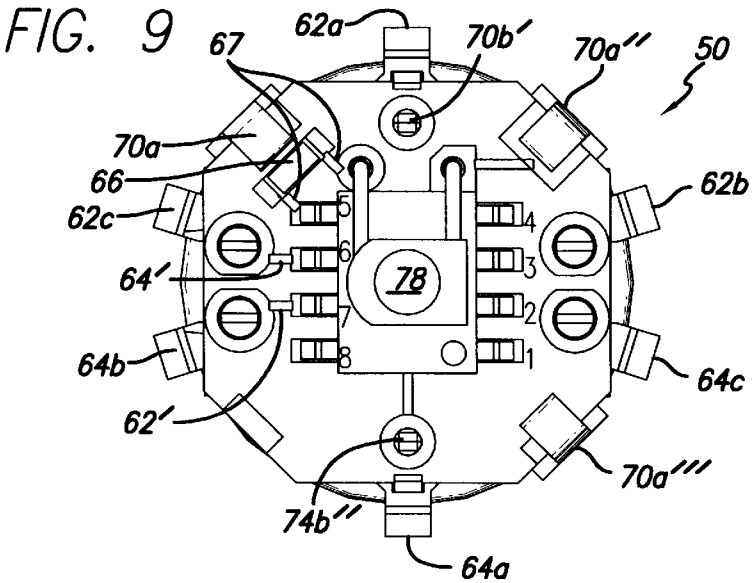
FIG. 9 is a top view of the liquid flow meter.
Figure 12:
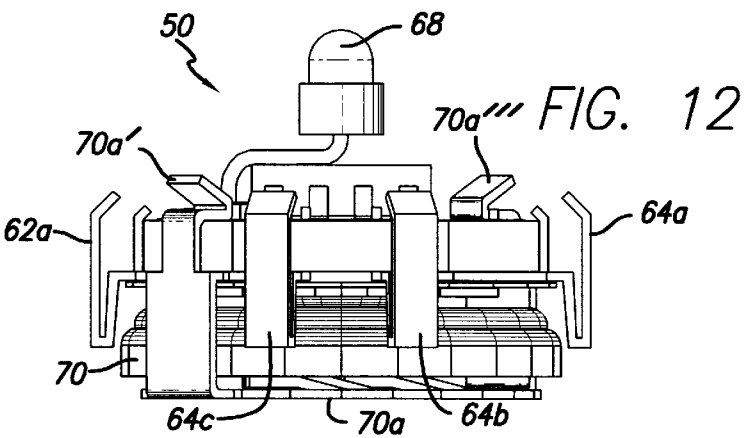
FIGS. 11 and 12 are side views of the liquid flow meter, with one view being taken 90° from the other.
Figure 11:
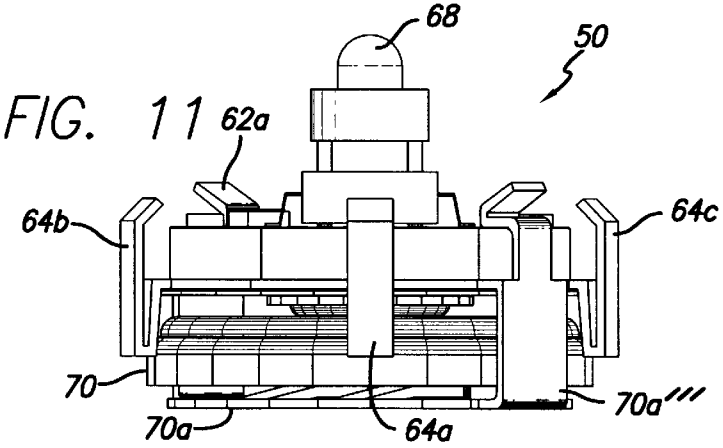
Figure 15:
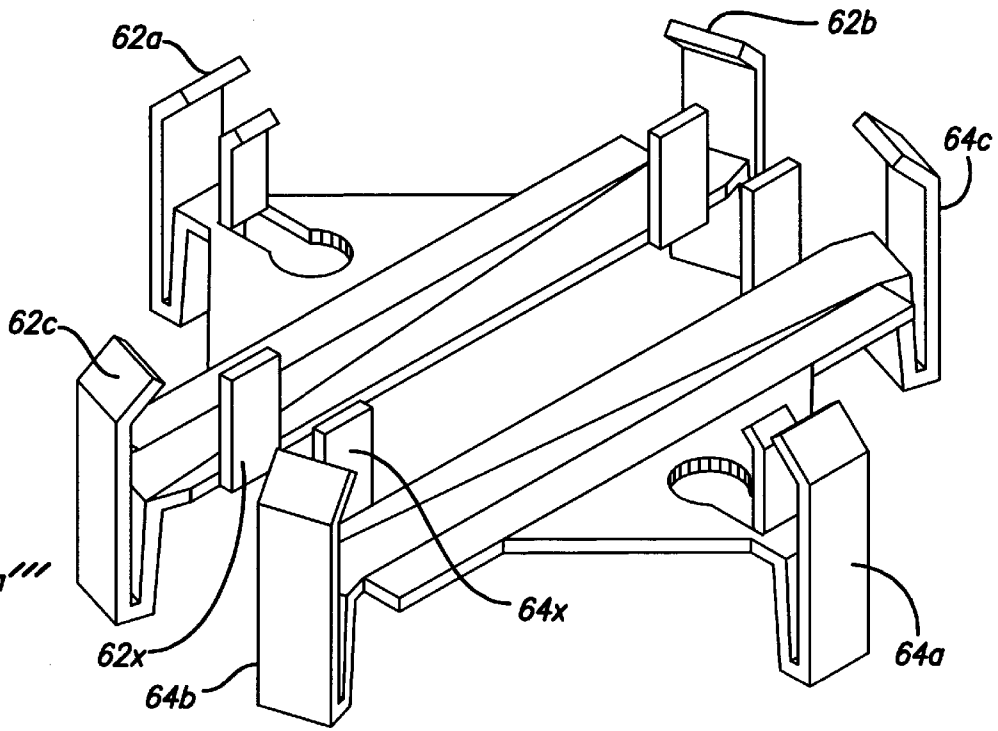
FIG. 15 is a perspective view of the sensor contact clips employed in the liquid flow meter illustrated in FIGS. 8–12.
Figure 13:
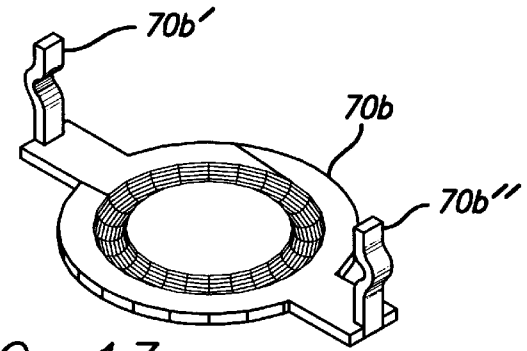
FIGS. 13 and 14 are perspective views of the respective negative and positive battery clips used in the liquid flow meter illustrated in FIGS. 7–11.
Figure 14:
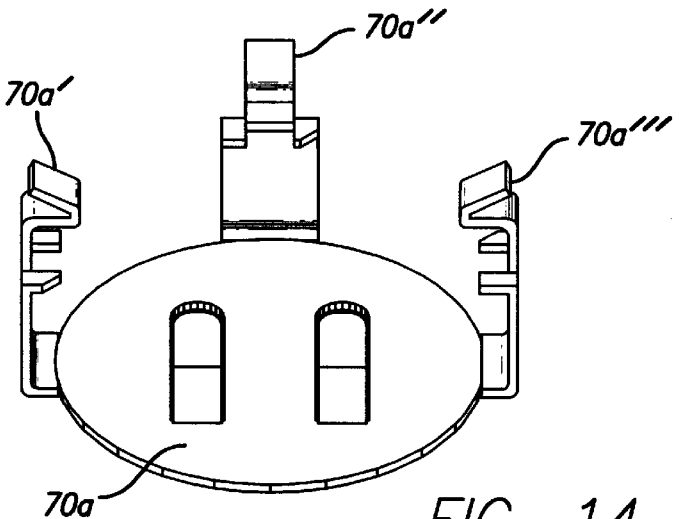

The electric circuit embodied in liquid flow meter 50 is shown in FIG. 6. The driving mechanism of the meter is embodied in a microcontroller 60, such as a 12LC508A-04/SN microcontroller, which is one of a PICD12C5XX family of microcontrollers from Microchip Technology. The PICD12C5XX is defined as a family of low-cost, high performance, 8-bit, fully static, EEPROM/EPROM/ROM based CMOS microcontrollers. It employs a RISC architecture with 33 single word/single cycle instructions. All instructions are single style (1 $\mu$s) except for program branches which take two cycles. The PICD12C5XX includes 12-bit wide instructions which are highly symmetrical, resulting in 2:1 code compression.

Microcontroller 60 is provided with eight input and output pins (numbers 1–8) in which pins "6" and "7" are coupled to a pair of contact sensor probes 62 and 64 at their respective contact points 62*x* and 64*x* respectively by leads 62' and 64'. Pin "5" is coupled through a resistor 68 to a LED 68 through the intermediary of leads 67, and pin "1" is coupled to a source of power "VCC" 70, such as a 3.3 volt lithium battery, e.g., CR1220. The couplings to the positive side of battery 70 is through a connection device having three termini, respectively designated battery clip (positive) 70 and 70*a', a", a'"* (see FIGS. 7–14). The couplings to the negative side of battery 70 are through a connection device having two termini, respectively designated battery clip (negative) 70 and 70*b', b"* (also see FIGS. 7–14). These termini act both as clips and as electric connections aided, for example, by soldering. LED 68 is coupled to power source 70. Pin "8" is grounded, as designated by indicium 76. Functioning of the microprocessor and its circuit are described below.

The various connections among the several electric components including microcontroller 60, sensor probes 62 and 64, resistor 66, positive and negative battery clips 70*a* and 70*b* are enabled by a circuit board 78. Where needed, insulation is provided, such as by a clip insulator 80.

As best shown in FIGS. 2–5, sensor probes 62 and 64 are positioned in liquid flow meter 50 so that their exposed termini 63 do not extend to the bottom surface (designated by indicium 65) of the meter and, therefore, are spaced from cover 26. This spacing of termini 63 avoids undesired closure between the probes, should, for example, the level of the liquids in odor trap 20 rise during use through entry 36 in cover 26. Further, the spacing between termini 62*c* and 64*b* and between termini 62*b* and 64*c*, in particular, is limited to a minimum distance to avoid unintentional contact therebetween, for example, of droplets of wastewater that have not passed through entry 36.

Figure 16:
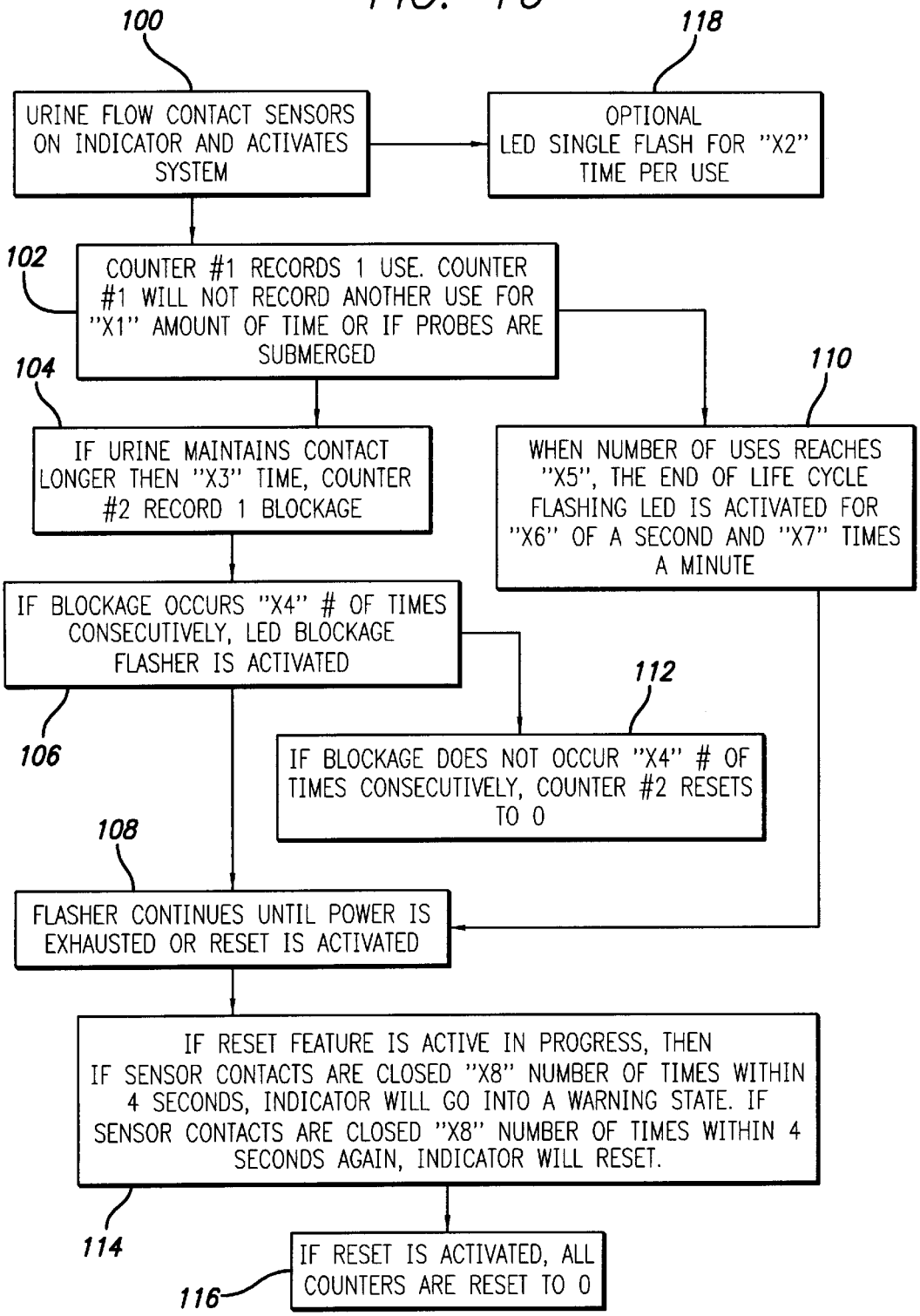
FIG. 16 is a logic flow chart depicting the algorithm utilized in operating the liquid flow meter of the present invention.

Reference is now made to FIGS. 16 and 17. FIG. 16 illustrates the flow of logic used in sensing and measuring the activities occurring in odor trap 20. The glossary of terms used in the following is:

"Uses"—A use is when the sensor contacts detect the presence of a fluid, within a specified period of time.

"Use Counter" or "Counter #1"—Counts the total number of uses

"Use Timer" or "Timer #1"—A Use Timer determines the period of time between initial fluid contact and when the next fluid contact can be recorded.

"Blockage"—A blockage is when fluid is detected by the sensor contacts continuously for a specified amount of time.

"Blockage Timer" or "Timer #2"—Blockage Timer records records the duration of continuous fluid presence by the sensor contacts.

"Blockage Counter" or "Counter #2"—Blockage Counter records the number of blockages as determined by Blockage Timer, when the timer exceeds a specific minimum amount of time.

Further, in the following exposition of the algorithm, the term "X" indicates time which is a programmable variable, to which reference is directed to FIG. 17. Operation is assumed that meter 50 is in an inactive "turned-off" condition. Operation commences, as shown in enclosure 100, when urine flow contacts sensors on indicator or meter to activate the system. As shown in enclosure 102, counter #1 in microprocessor 60 records one use. Counter #1 will not record another use for "X1" amount of time or if probes 62 and 64 are submerged. If, as depicted in enclosure 104, the urine maintains contact between the probes for a time longer than an "X3" period of time, counter #2 records one blockage. In the next step, as outlined in enclosure 106, if blockage occurs "X4" number of times consecutively, LED 68 flashes to indicate a blockage. As shown in enclosure 108, flashing continues until power is exhausted or reset is activated. However, as pointed out in enclosure 112, if blockage does not occur for "X4" number of times consecutively, counter #2 resets to 0.

Alternatively, as stated in enclosure 110, when the number of uses reaches "X5", the end of the lifecycle of flashing LED 68 is activated for "X6" of a second and "X7" times a minute, and the program proceeds directly to the step outlined in enclosure 108, that is, flashing continues until power is exhausted or reset is activated.

The next step proceeds to that embraced in enclosure 114, if the reset feature is active in progress, that is, if the sensor contacts are closed "X8" number of times within 4 seconds, the indicator/meter 60 will proceed to a warning state. If the sensor contacts are closed "X8" number of times within 4 seconds again, the indicator will reset. Finally, as circumscribed in enclosure 116, if reset is activated, all counters are reset to 0.

Optionally, as set forth in enclosure 118, LED 68 will single flash for "X2" time per use.

Several materials may be used in the present invention. The cover shell may be made of any number of thermoplastic materials such as ABS or polypropylene plastic. The electronics are held in place in the mold by the location of the LED and the sensor contact points. Although injection molding is one method of encapsulation, other methods could be used successfully, such as potting and cold injection.

The present invention is installed by placing the split ball stem (connector 52, post 54, post 56, pair of tangs 56, bosses 58) located at the base of the indicator into mounting hole 42 located in the center of drain holes 36 on the top or cover of the cartridge.

The present invention operates in three states:

1. Packaged: Preinstalled into the lid of the cartridge, the indicator is active but in a sleep mode.
2. Installed: Indicator and cartridge is installed in a urinal and ready for first urine contact. No information is stored save for the ROM programming.
3. Initial Fluid Detection: The high mineral content of the urine (or water, which has a lesser mineral content) will complete the circuit between the sensor probes, powering the chip and allowing information to be stored.

In one embodiment, the algorithm of the Fluid Detection state, as noted above, is as follows:

1. Upon each detection of fluid, "Use Counter" will increment by (1), and "Use Timer" records Duration of fluid detection. The "Use Counter" will not record another use for a short, predetermined amount of time (e.g., 50 seconds) to avoid falsely recording two uses, when only one use should be recorded or as long as the fluid is still present.
2. If number of uses (Use Counter) is greater than the predetermined number (in one embodiment, 7000), the unit activates Change Signal (continuous or flashing LED).

3. If the Time Duration of fluid detection is greater than the predetermined value (in one embodiment, 75 seconds), Blockage Counter increments by (1).
4. If Blockage Counter equals the predetermined number (in one embodiment, 3) and these events are consecutive, unit activates Change Signal (FLASH).
5. If the predetermined number of Blockage Events is not consecutive then the Blockage Counter will reset to zero.

In an alternative embodiment, a reset feature is provided:

1. If time duration of flow is less than one second, very short predetermined value (in one embodiment, 0.5 seconds), clicks the Reset Counter once, and tracks Reset Time.
2. If the Reset Counter equals a predetermined value (in one embodiment, 10) and the Reset Time is less than or equal to a predetermined value (in one embodiment, 5 seconds), all counters are reset to zero.
3. If Reset Time is greater than a predetermined value (in one embodiment, 5 seconds) resets Reset Counter and Reset Time to zero.

In a related alternative embodiment, a feature is provided to signal if the urinal is blocked: If time duration of flow is greater than a very long predetermined value (in one embodiment, 75 seconds, for example), the unit activates Change Signal.

In an alternative embodiment, the present invention will give a Change Signal triggered by a total time in service.

1. Upon Initial Fluid Detection, Powers Chip and initiates Duration Clock.
2. When Duration Clock reaches a predetermined number of days (in one embodiment, 90 days) activates Change Signal.

In another alternative embodiment, the present intention will flash an LED every time it is in use:

1. Upon Fluid Detection, activates In-Use Flash Signal (1/10 second) to indicate the device is working. In-Use Flash Signal feature resets upon end of Fluid Detection.

In the another alterative embodiment, the present invention uses a second LED to provide an in-use signal, and the first LED for overfill. The two LED's may employ different colors. Further, different colors and different LED's may be used for different signals.

The device can be employed in a flush urinal, by connecting it to a solenoid valve that cuts off the flow of flush water in the event of blockage. The connection may be by hard wire or transmitter and receiver.

Although water has a lower mineral content and will work, a properly adjusted sensor is needed to determine the difference between water and urine. Thus, in an alternative embodiment, the resistance limit is set so that water, which may be used to flush out the system, is not recognized, but urine is.

Although the invention has been described with respect to a particular embodiment thereof, it should be realized that various changes and modifications may be made therein without departing from the spirit and scope of the invention.

What is claimed is:

1. An electric circuit for monitoring the flow of at least one electrically conductive liquid through a trap in a urinal to determine when the trap needs to be changed or serviced, comprising:

a microcontroller for sensing the presence and duration of the presence of the conductive liquid and for directing actions established by preset criteria;

at least one pair of contact sensor probes coupled to said microcontroller and disposed to be electrically connected together by the electrically conductive liquid; and an indicator coupled to said microcontroller for indicating the actions directed thereby.

2. An electric circuit according to claim 1 in which said microcontroller comprises an 8-bit, fully static, EEPROM/EPROM/ROM based CMOS microcontroller.

3. An electric circuit according to claim 1 in which said microcontroller records the number of liquid flows and if the number exceeds a second predetermined number appropriately activates said indicator.

4. An electric circuit according to claim 1 in which:

said microcontroller, said contact sensor probes and said indicator are housed in a liquid flow meter enclosure;

said trap includes an entry and an exit for respectively receiving and discharging the liquid and structure at said entry for receiving said liquid flow meter; and said contact sensor probes are spaced from said entry structure for avoiding undesired electric closure between the probes by the conductive liquid.

5. An electric circuit according to claim 4 in which said liquid flow meter enclosure includes a latching mechanism latchingly engageable with said entry.

6. An electric circuit according to claim 1 in which said microcontroller is programmed to sense flow of the conductive liquid by said probes, to sense the length of time of the liquid contact and compare it to a predetermined length of time and if the time of liquid contact exceeds said predetermined length of time, to record a blocked condition, and to appropriately activate said indicator if the number of blocked conditions exceeds a predetermined number.

7. An electric circuit according to claim 6 in which said indicator is activated if the preset number of blocked conditions occur without intervening liquid contact of a duration that does not exceed said predetermined length of time.

8. An electric circuit according to claim 1 in which said microcontroller is programmed to sense flow of the conductive liquid by said probes, to activate said microcontroller when the conductive fluid is sensed, to record the number of sensed flows with respect to liquid contact of the probes, to count the length of time of the liquid contact that may evidence a blockage, to appropriately activate said indicator in response to the blockage, and to reset said microcontroller if blockage does not occur a preset number of times consecutively.

9. In a urinal having a removable trap having a urine flow path, a method for determining when the trap requires changing and servicing by use of a microcontroller and a designator for respective effecting of the changing and servicing, comprising the steps of:

sensing flow of the urine;

activating the microcontroller when the urine is sensed;

recording the number of sensed flows with respect to contact with the urine;

sensing the length of time of the urine contact and any blockage and times of blockage produced thereby;

appropriately activating the designator in response to the blockage sensing; and resetting the microcontroller should blockage not occur a preset number of times consecutively.

10. A method according to claim 9 in which:

said step of sensing flow of the urine comprises the step of utilizing contacts positioned in a path of the urine flow, and activating the microcontroller when urine is sensed;

said recording step comprises the steps of counting a first sensing and not recording another sensing for a preset amount of time or if the contacts are submerged in the urine;

said step of sensing the length of time of the urine contact and any blockage and times of blockage produced thereby comprises the steps of determining if the urine maintains contact longer than a preset length of time, and recording the longer period of time as a blockage incident; and said appropriate designator activation step comprises the steps of detecting a preset n umber of consecutive times that the blockage occurs, when the number of sensing reaches a preset number, activating the designator for a preset length of time and for a preset number of times per unit of time, and continuing said detector activating step until power is exhausted or a reset is activated.

11. A method according to claim 9 in which said resetting step further comprises the steps of:

placing the designator in a warning condition if sensor contacts are repeatedly closed a preset number of times within a preset length of time; and resetting the time of said counting steps to zero if blockage does not consecutively occur a present number of times.

* * * * *